United States Patent [19]

Miffitt et al.

[11] Patent Number: 4,957,291

[45] Date of Patent: Sep. 18, 1990

[54] ELECTRONIC PUZZLE

[75] Inventors: Donald C. Miffitt, Chelmsford; Angelo Tortola, Lexington; Charles S. Sebor, Reading; Robert L. Halliday, Lexington, all of Mass.

[73] Assignee: Venture Technologies, Inc., North Billerica, Mass.

[21] Appl. No.: 433,389

[22] Filed: Nov. 6, 1989

Related U.S. Application Data

[63] Continuation of Ser. No. 166,927, Mar. 11, 1988, abandoned.

[51] Int. Cl.[5] ..... A63F 9/06

[52] U.S. Cl. ..... 273/153 R; 273/1 E

[58] Field of Search ..... 273/153 R, 237, 1 E, 273/153 S, 146

[56] References Cited

U.S. PATENT DOCUMENTS

| | | | |
|---|---|---|---|
| 4,240,683 | 12/1980 | Morrison et al. | 273/237 |
| 4,320,901 | 3/1982 | Morrison et al. | 273/237 |
| 4,323,243 | 4/1982 | Hanson et al. | 273/153 |
| 4,337,948 | 7/1982 | Breslow et al. | 273/237 |
| 4,513,973 | 4/1985 | Sinclair | 273/237 |
| 4,575,087 | 3/1986 | Sinclair | 273/153 |
| 4,809,979 | 3/1989 | Skowronski et al. | 273/153 R |

*Primary Examiner*—Edward M. Coven
*Assistant Examiner*—Jessica J. Harrison
*Attorney, Agent, or Firm*—Choate, Hall & Stewart

[57] ABSTRACT

An electronic game that includes a main body that consists of four panels assembled to form a four-sided pyramid having four vertexes. Each vertex serves as a node for supporting a light which may illuminate a plurality of different colors. Digital circuitry defines a color state vector at each node by illuminating one or none of the colors. Control circuitry connected to the digital circuitry is used for altering the color state of at least one of the lights as the tetrahedron is rotated. In one game, the color of the node brought to the top position changes in the color change pattern established by the color state vector. A player rotates the tetrahedron in an effort to figure out the pattern of color changes. Once the pattern is deciphered, the player makes additional rotations to achieve an object of the game such as having each vertex of the tetrahedron lighted the same color.

14 Claims, 8 Drawing Sheets

ELECTRONIC PUZZLE

This is a continuation of copending application(s) Ser. No. 07/166,927 filed on Mar. 11, 1988 now abandoned.

BACKGROUND OF THE INVENTION

This invention relates to an electronic puzzle or game.

U.S. Pat. No. 4,575,087 discloses an electronic puzzle configured as a cube. The puzzle stores a fixed, predetermined sequence of orientation changes which will result in all of the faces of the cube being illuminated. Only if a player makes the predetermined sequence of orientation changes in the correct order will the faces be illuminated. In this patent, each face of the cube or other polyhedron can be in only one of two possible states such as ON or OFF.

Other electronic games are known which generally include a keyboard through which a player interacts with the game. See, for example, U.S. Pat. Nos. 4,513,973; 4,240,638; 4,320,901 and 4,323,243. The puzzle such as that disclosed in U.S. Pat. No. 4,575,087 discussed above requires both three-dimensional orientation skills and memory skills to memorize sequences of movements to be performed in order to achieve a solution.

SUMMARY OF THE INVENTION

The electronic puzzle according to the invention includes a puzzle body having a plurality of lightable positions, each lightable position capable of being illuminated in one of a plurality of colors. Digital circuitry is provided to establish a color state vector defining a pattern of color changes for each lightable position. Control circuitry interconnected with the digital circuitry changes the color of at least one of the lightable positions to the next color in the color state vector in response to a player's manipulation of the puzzle body. One object of the puzzle is to have each lightable position illuminated the same color.

Preferred embodiments of the invention include the following features. The main body consists of four panels assembled to form a tetrahedron. A light is supported at each of its four vertexes. Each light may consist of a group of differently colored lights, which may include a red, green, and yellow LED, for example, or a single light capable of shining in several colors. Each light is illuminated according to a color state vector stored in a microprocessor. The control circuitry includes a position sensor switch for informing the digital circuitry of the current position of the tetrahedron. The position sensor switch consists of a housing having a cavity that defines four positions, each corresponding to one of the vertexes. Conducting pins at three of the four positions are used to inform the digital circuitry of the location of a ball that is free to roll to any of the positions within the cavity. The position sensor switch is also used to select different games stored in the microprocessor.

As the tetrahedron is rotated to bring a vertex to an upright position, a different color (or off) is illuminated. One of the games, which may be stored in the microprocessor, has as its object the lighting of the same color at each node. Many other games may be stored in the microprocessor, as will be discussed to provide nearly limitless play. The puzzle utilizes flashing colored lights that will provide visual entertainment, especially in a darkened room. The pyramid shape itself is another appealing feature. The electronic puzzle is also a very inexpensive product to manufacture.

According to the invention, each time a vertex is rotated to an upright position, the color of that vertex changes to the next color in the color state stored in a microprocessor. A player rotates the tetrahedron in an experimental fashion to try to figure out the pattern of color changes. Once the pattern is deciphered, the player continues manipulating the tetrahedron in an effort to achieve a solution such as having each vertex illuminated the same color. Successive plays by the same or different players will likely result in different patterns of rotations, all such patterns resulting in solving the puzzle. Thus, a virtually infinite set of orientation changes will solve the puzzle according to this invention. This is unlike the puzzle of U.S. Pat. No. 4,575,087 in which a predetermined sequence of orientations is required to solve the puzzle. The puzzle of the invention thus provides a much richer universe of situations resulting in a much more interesting puzzle than known in the prior art.

DESCRIPTION OF THE PREFERRED EMBODIMENT

Figure 1:
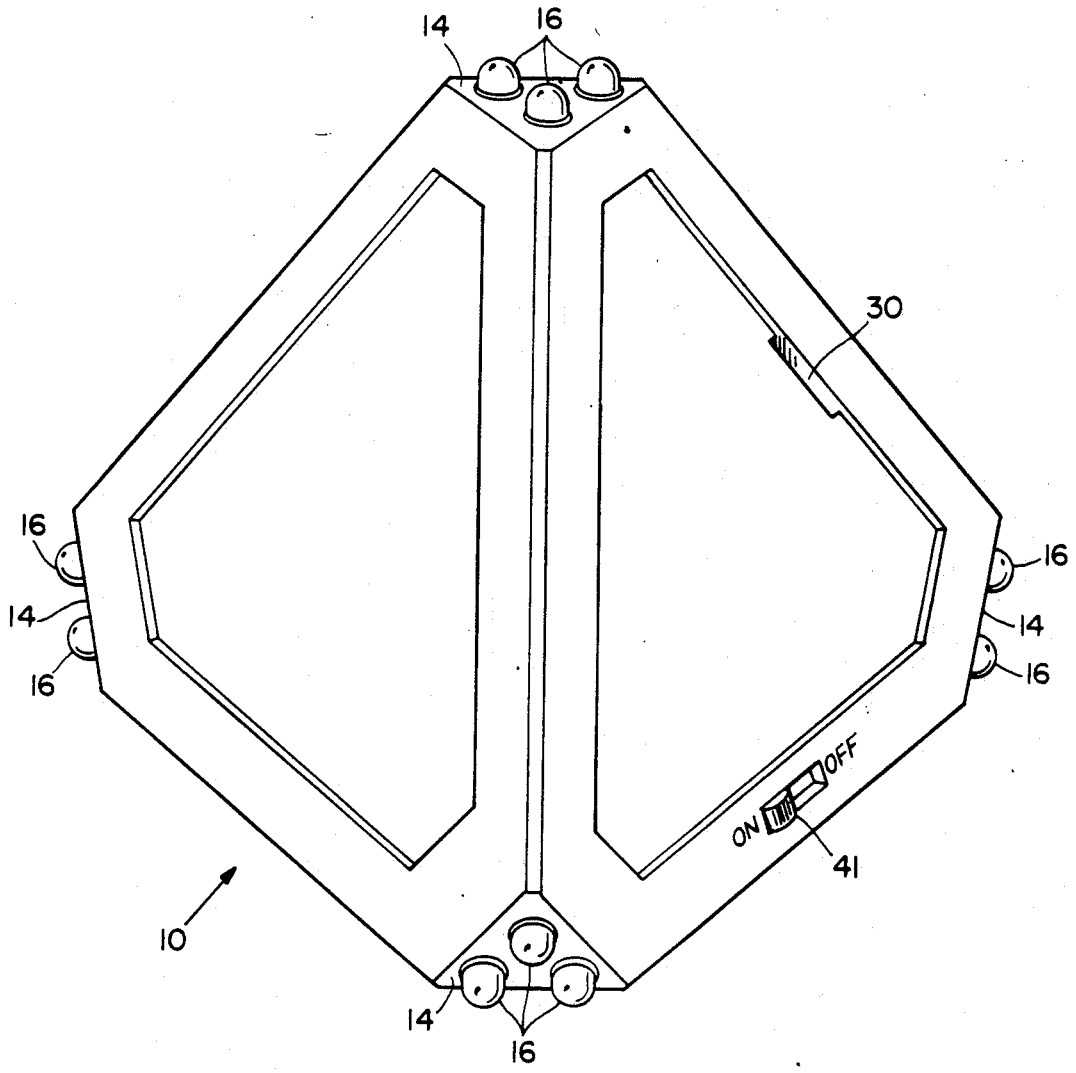
FIG. 1 is a perspective view of the electronic puzzle of the invention having different colored LEDs at each of its four vertexes or nodes.
Figure 1A:
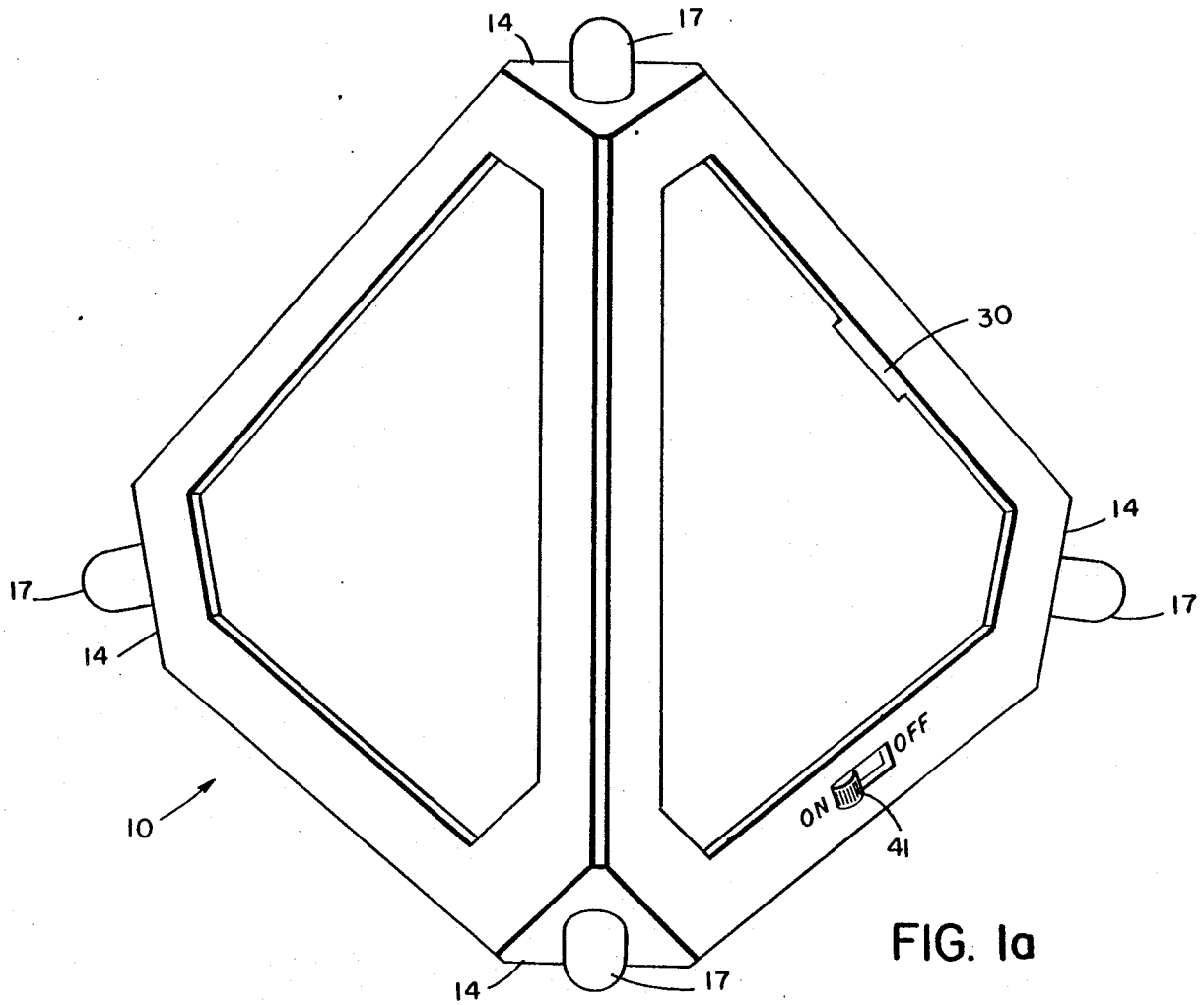
FIG. 1A is a perspective view of the electronic puzzle having a single light at each vertex.

Referring to FIG. 1, an electronic puzzle in the form of a tetrahedron 10 is shown. Tetrahedron 10 has four vertexes, each serving as a node or lightable position 14 for positioning three different colored LEDs 6. These LEDs 16 are preferably red, green and yellow, but any color may be used. Each node 14 is numbered 1 to 4 (not shown) to allow a player to distinguish one from another. FIG. 1A shows an embodiment of the invention including a single light 17 at each of the nodes 14. Each of the lights 17 is capable of shining in multiple colors such as red, green, and yellow. The lights 17 may be LEDs including red and green elements disposed behind a common clear lens. Red and green colors are achieved by activating either the red or green dye portions of the light and a yellow-orange color is achieved when both red and green elements are activated.

Figure 2:
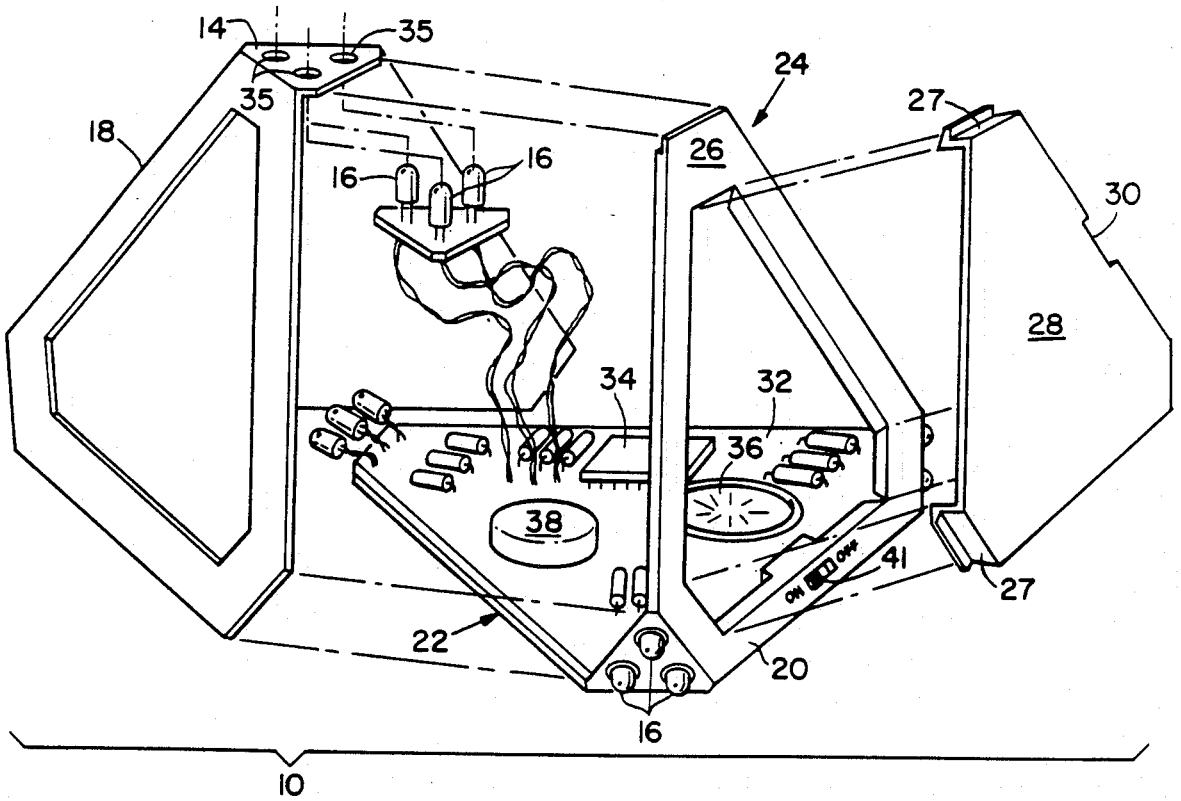
FIG. 2 is an exploded perspective view of the electronic puzzle of FIG. 1.

Shown in FIG. 2, the tetrahedron 10 consists of two case halves 18, 20 that are made from rigid durable material such as plastic. Lower case half 20 includes a bottom panel 22 and a side panel 24. Bottom panel 22 supports a circuit board 32, which electronically controls LEDs 16 inserted through holes 35 at each node 14. Side panel 24 consists of a frame 26 and a battery door 28 that is secured to frame 26 by flanges 27. Battery door 28 includes a slot 30 for prying the door 28 from frame 26 with a flat object, such a coin, permitting access to circuit board 32. A power switch 41 recessed in frame 26 turns the game on and off.

Figure 3:
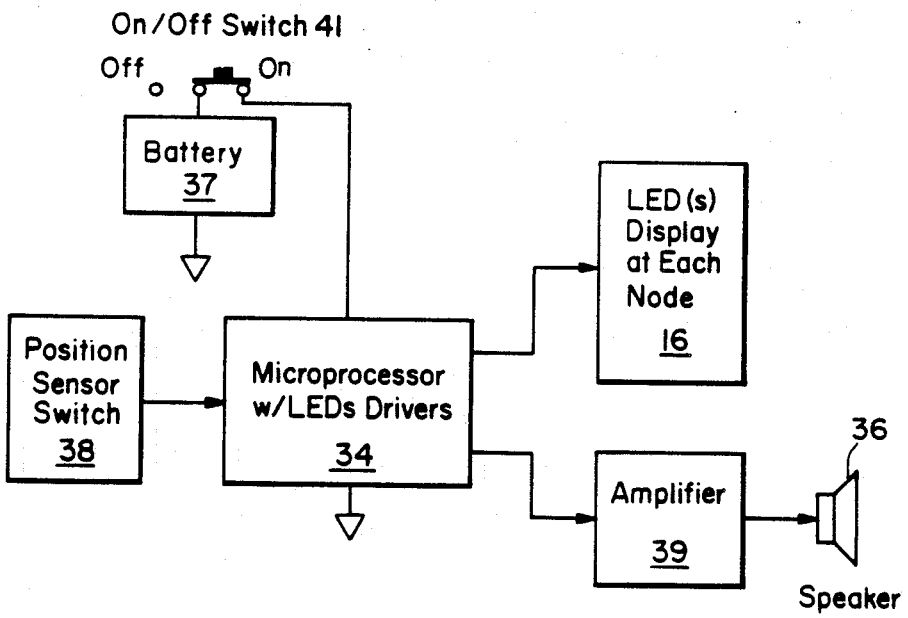
FIG. 3 is a block diagram of the circuit driving the LED displays at each node.

Referring to FIG. 3, the power switch 41 activates a microprocesor 34 by connecting it to a battery 37, which consists of 4 AA cell batteries. Once activated, microprocessor 34 samples a position sensor switch 38 for information which is used to control the color state of LEDs 16 at each node 14 or the single light 17 of FIG. IA. In the preferred embodiment microprocessor 34 controls the state of only one LED 16 at each node 14 at any time. A change in the color state of any node 14 is governed by the ordering of the "Color State Vector". As an example, the Color State Vector may be defined as:

GREEN-OFF-YELLOW-OFF-RED

After the RED state, the color state of the node would return to GREEN. The color state may be advanced one position from left to right in the Color State Vector or right to left. Many other Color State Vectors are also possible.

Microprocessor 34 also controls an audio device such as a speaker 36 via an amplifier 39. The speaker 36 provides action sounds, for example clicking or beeping sounds, indicating a change in the color state at one of the nodes 14.

The object of the game is to manipulate the tetrahedron 10 into a state where all nodes 14 are lit by the same color, for example when all of the red LEDs are lit. To accomplish this, the top node becomes the reference node. Thereafter, the color state at each node is advanced by selectively rotating the tetrahedron so that different nodes become the top node. The microprocessor 34 is continuously informed as to which node 14 is currently the top node by position sensor switch 38.

The puzzle of the present invention is based on a player's deciphering the color state vector pattern, that is, the pattern of switching from one color to the next as a node is brought to the upright position. A player will thus manipulate the tetrahedron 10 bringing successive nodes to the top in an effort to figure out the pattern of color changes. After the player has deciphered the code, he then makes further rotations of the tetrahedron in hopes of solving the puzzle such as having each node lighted red. There is thus no unique set of rotations necessary for solving the puzzle.

Figure 4B:
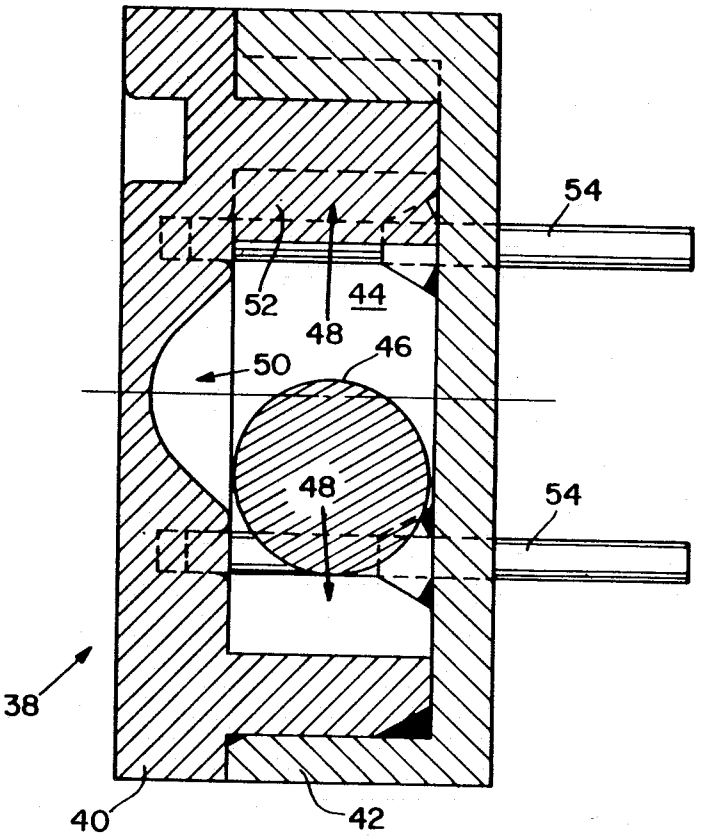
FIG. 4B is a side sectional view along the line B—B of the position switch of FIG. 4A.
Figure 4A:
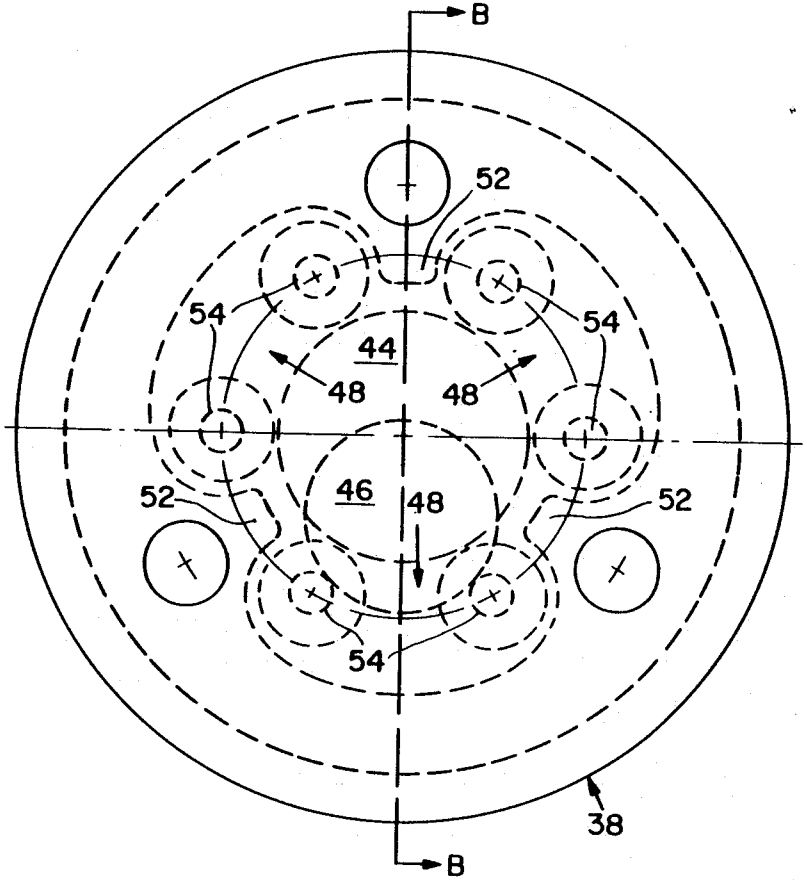
FIG. 4A is a top view of a positional switch used to indicate which of the four nodes is in the top position.

Shown in FIGS. 4A and 4B, position sensor switch 38 includes a cylindrical base 40 and cover 42 assembly that is approximately ½ inch in diameter and ¼ inch in height, and made from electronically insulating material such as plastic. The assembly defines a cavity 44 that permits a conductive ball 46 to roll to one of four possible positions as indicated by arrows 48 and 50. Ball 46 is approximately ⅛ inch in diameter, and made of silver plated steel. Three of the positions (indicated by arrows 48) are located between walls 52 of base 40, which extend into cavity 44. A pair of contact pins 54 are disposed at each of these positions. When ball 46 is placed in contact between the pins an electrical connection is made. Contact between pins from adjacent positions is prevented by wall 52. The fourth position (indicated by arrow 50) is located at a depression 56 formed in base 40. When the ball 46 is in this position, it is electrically isolated from any of the contact pins 54. Each of these four positions corresponds to a node 14.

Figure 5:
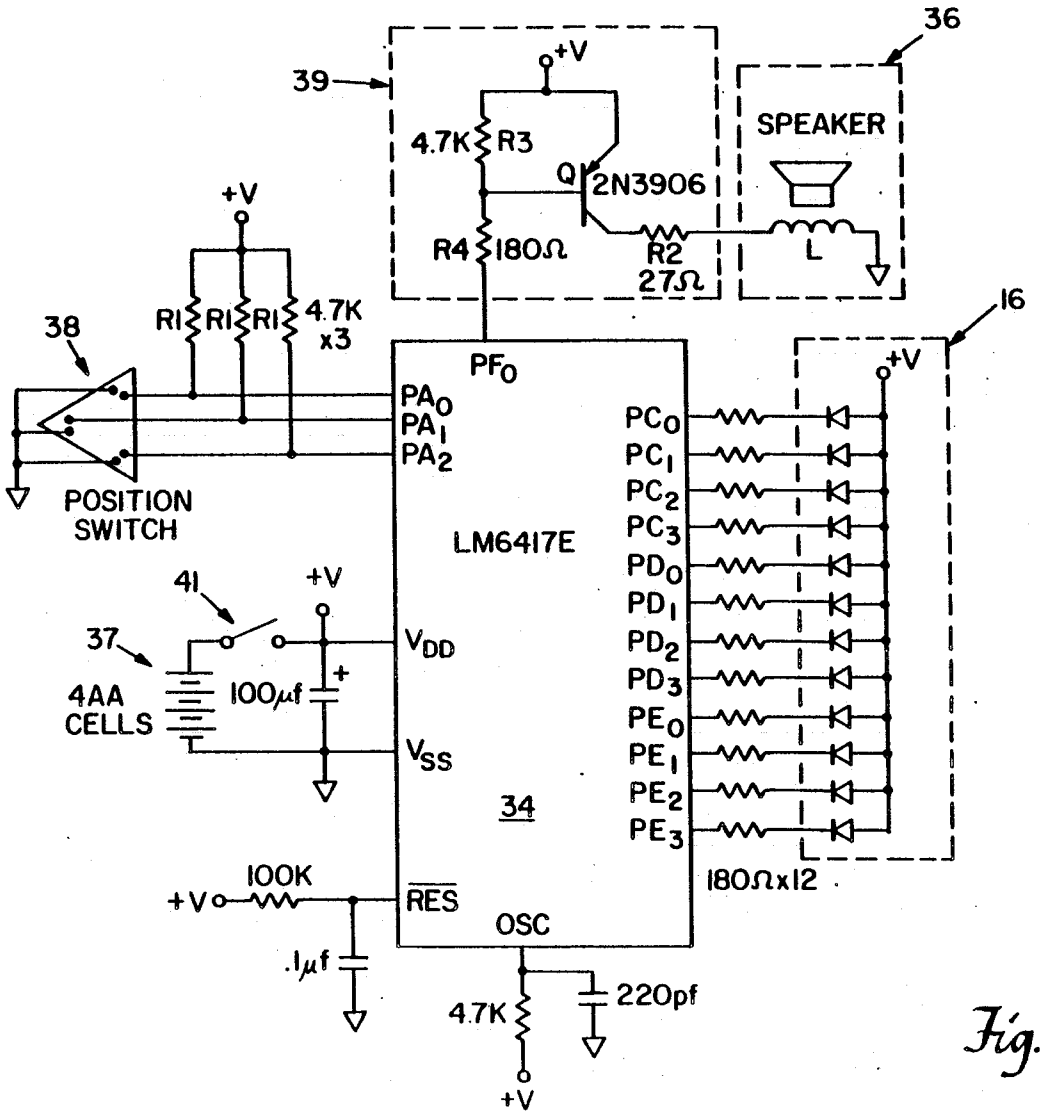
FIG. 5 is an electronic diagram of the electronic puzzle.

As shown in FIG. 5, position sensor switch 38 operates as a three-way switch to inform microprocessor 34 of the relative position of the tetrahedron 10. Microprocessor 34 detects the position of the ball 46 by simultaneously sampling the voltage at each pin 54 connected to the positive terminal of the battery 37 via resistors R1 and power switch 41. Depending on the position of ball 46, the microprocessor is programmed to drive LEDs 16 according to the Color State Vector at the nodes 14.

In the preferred embodiment, the rules for five games are stored in the microprocessor. The first four games are selected by chosing one of the nodes as the top node before turning the power switch on. For example, if the node labeled 1 is the top node when power is turned on, game 1 will be played. If the node labeled 2 is the top node, game 2 will be played and so on. Game 5 may only be played at the end of game 4; that is, when all 4 nodes are red the microprocessor will switch to a game 5 mode. Typically, game 1 would be the easiest of the games and game 5 would be the most difficult. As an example, rules for playing each of the five games stored in the microprocessor are as follows:

GAME 1 consists of advancing one color in the selected top node according to the Color State Vector;

GAME 2 consists of advancing one color in the selected top node and advancing one color in the previous top node;

GAME 3 consists of advancing one color in the selected top node if that node was not visited in the previous two turns;

GAME 4 consists of advancing one color in each of the three nodes that are not the selected top node; and GAME 5 consists of advancing one color in the selected top node, advancing one color in the previous top node and backing up one color in each of the remaining two nodes.

As demonstrated by the above rules, the patterns of play can become intricate and involved.

The processor is also programmed to enable an amplifier 39 to drive speaker 36 whenever a color state changes. Amplifier 39 includes a transistor Q having its emitter tied to the positive terminal of the battery and its collector tied to a voice coil L of speaker via resistor R2. The base of transistor Q is connected between a resistor R3 tied to the positive terminal of the battery 37 and a resistor R4 tied to the microprocessor 34 at an output terminal PFo. When microprocesor 34 drives the output terminal PFo low, transistor Q is enabled, thereby activating speaker 36.

When the puzzle is first powered up, or at the end of a game, software stored in microprocessor 34 idles in a pre-execution mode waiting for a new switch closure to start the next game. During the waiting period, microprocessor 34 runs a "light show" to keep idle spectators amused. During this light show, four LEDs 16 are continuously lit, one at each node 14. Every 40 milliseconds, a different node is visited, the current LED is turned off, and the next LED is turned on.

Figure 6:
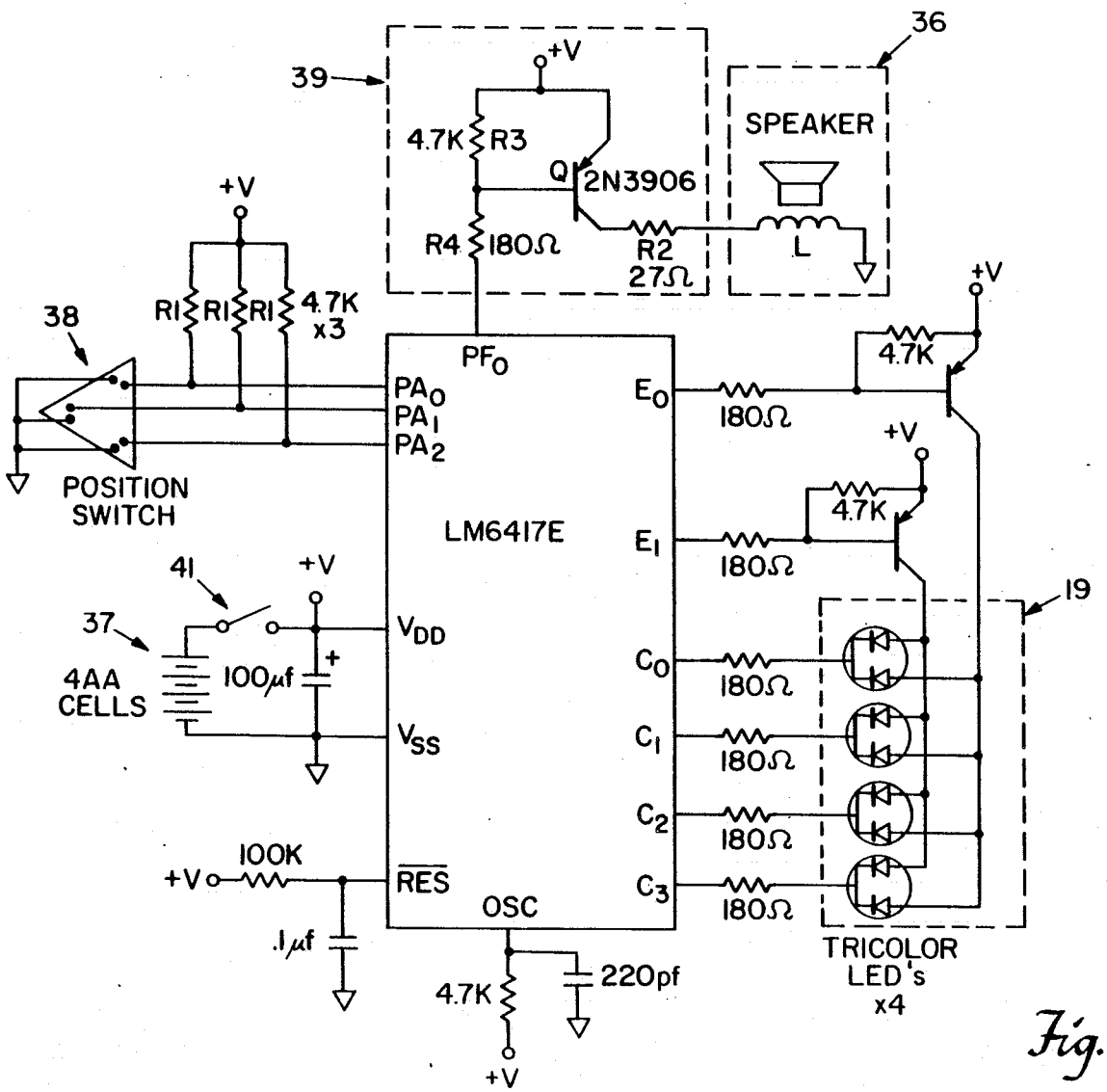
FIG. 6 is an alternate electronic diagram of the electronic puzzle.

As shown in FIG. 6, tricolored LEDs 19 may be substituted for the individual LEDS 16 shown in FIG. 5.

As an example of the software design for executing the games, six software modules are appended below.

```
POWER ON
DISABLE INTERRUPTS.
INITIALIZE STACK POINTER.
INITIALIZE I/0 PORTS TO EITHER INPUTS OR
OUTPUTS.
CLEAR OUTPUT PORTS.
CLEAR RAM TO ALL ZEROES.
CALL SWITCH READING.
SET "GAME" = CURRENT SWITCH READING.
INIT 40 MILLISECOND PRE-EXEC TIMER.
JUMP TO PRE-EXEC.
PRE-EXEC
PRE-EXEC LOOP: DO WHILE (NO NEW SWITCH
CLOSURE)
HAVE 40 MS PASSED?
IF YES, THEN DO:
RESTART 40 MS TIMER.
VISIT N'TH OF 4 NODES.
TURN OFF X'TH LED AT N'TH NODE.
TURN ON X + 1'TH LED AT N'TH
NODE.
CALL SWITCH READING.
END PRE-EXEC LOOP.
JUMP TO EXEC.
EXEC
EXEC LOOP: DO WHILE (NOT END OF GAME)
CALL SWITCH READING
IF NEW SWITCH CLOSURE, THEN DO:
CALL GAME LOGIC
CALL DISPLAY UPDATE
CALL END OF GAME CHECK
END EXEC LOOP.
CLEAR END OF GAME FLAG.
IF "GAME" = 4, SET "GAME" = 5.
JUMP TO PRE-EXEC.
SWITCH READING
GET PREVIOUS SWITCH CLOSURE VALUE.
READ CURRENT SWITCH CLOSURE.
DO WE HAVE A NEW SWITCH CLOSURE?
IF YES, THEN DO:
DEBOUNCE NEW SWITCH CLOSURE
MAKE KEY CLICK SOUND
CONVERT I/0 VALUE TO KEY ID
VALUE.
GAME LOGIC
WHICH GAME ARE WE IN?
GAME LOGIC FOR GAMES 1-5.
END OF GAME CHECK
INSPECT THE STATE OF ALL 4 NODES:
ARE ALL 4 NODES = RED?
IF YES, THEN DO:
IF "GAME" = 5, THEN DO:
RUN END OF GAME 5 SHOW
ETERNALLY
ELSE DO:
RUN NORMAL END OF GAME SHOW
FOR 5 SECONDS.
SET FLAG: GAME HAS ENDED.
```

Figure 7:
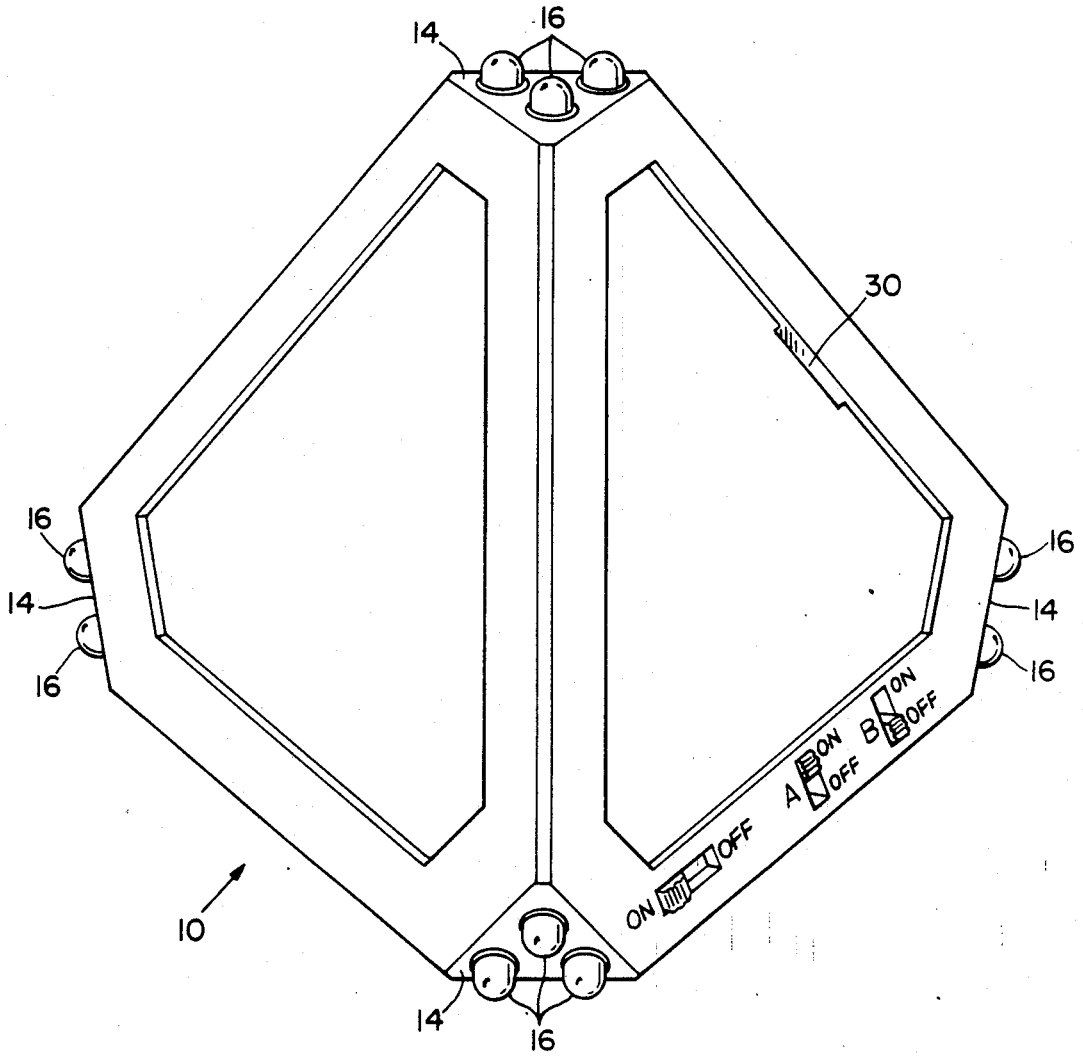
FIG. 7 is a perspective view of an alternate electronic puzzle having two additional switches for increasing the number of games that may be played.

Referring to FIG. 7, in an alternate embodiment two additional control switches labeled A and B are added for expanding the number of games (up to 16 games). A combination of switches A and B together with the position sensor switch 38, indicating which node is the top node, is used to inform the microprocessor 34 which games is to be played. As an example, rules for 10 games and how each of the games is selected when the power switch is turned on are explained in the following table;

| | SWITCHES | | |
|---|---|---|---|
| GAME | A-B | TOP NODE | RULES |
| 1 | 0 0 | 1 | (DEMONSTRATION GAME) The selected top node advances one color. |
| 2 | 0 0 | 2 | The selected top node and the previous top node each advance one color. |
| 3 | 0 0 | 3 | The selected top node advances one color only if it was not visited in the previous two turns. |
| 4 | 0 0 | 4 | Game 4 is the same as Game 3, with one additional rule: If the top node advances one color, the previous node will also advance one color. |
| 5 | 1 0 | 1 | The selected top node remains unchanged and all other nodes advance one color. |
| 6 | 1 0 | 2 | If the selected top node is node labeled #1, it will advance one color. Other nodes at the top will advance a color only if the previous top node was node #1, and the second previous top node was different from the current top node. |
| 7 | 1 0 | 3 | The selected top node equals the selected top node plus the previous top node (Modulo 4). |
| 8 | 1 0 | 4 | The selected top node and the 2 previous top nodes each advance one color. |
| 9 | 0 1 | 1 | Game 9 is the same as Game 8, with one additional rule: If the top node and the 2nd previous top node are the same, then the top node will remain unchanged. Only the previous top node will advance one color. |
| 10 | 0 1 | 2 | The selected top node and the previous top node advance one color. If a player returns to a node that he had just previously visited, all four nodes go blank! |

Figure 8:
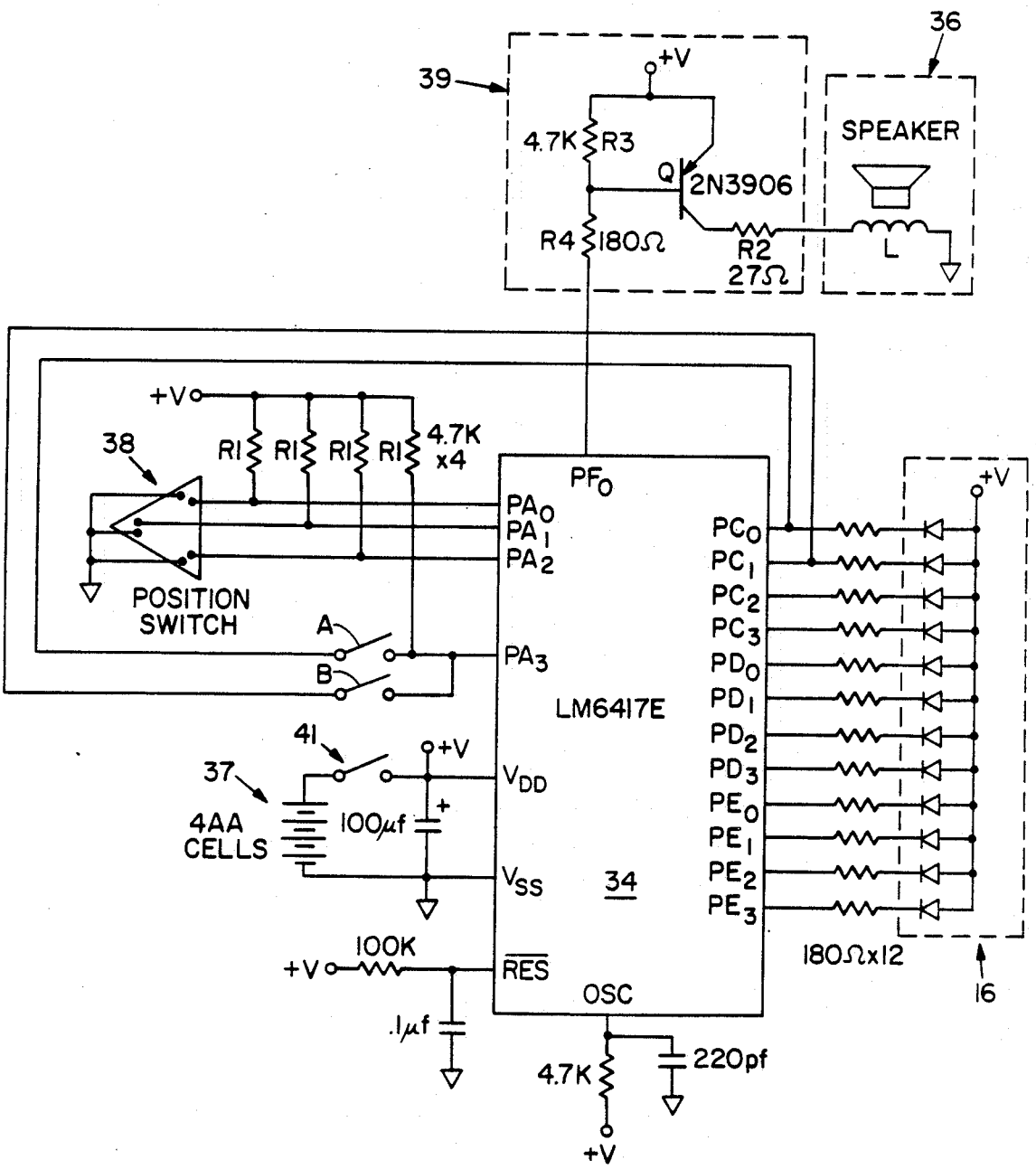
FIG. 8 is an electronic diagram of the electronic puzzle of FIG. 7.

Referring to FIG. 8, the circuit of FIG. 5 is modified by connecting switches A and B to microprocessor 34 as shown.

Other embodiments are within the following claims. For example, the puzzle may be expanded to a pentahedron or more sided figures having different colored lights at each of its vertexes. It may also be reduced to a planar board having groups of different colored lights arbitrarily located on the face of the board. The number of different colored lights at each node may be increased to four or more differently colored LEDs, and the color state at each node may be defined by a different color state vector. More than one light may be illuminated at each node to increase the complexity of play. The puzzle may also be equipped with a synthesizer for producing words or music at the completion of a game.

What is claimed is:

1. An electronic puzzle comprising:

(a) a puzzle body including a plurality of lightable positions, each lightable position capable of being illuminated in a plurality of colors;

(b) a first digital circuit for establishing color state vectors defining patterns of color changes for each lightable position, a single color state vector being assigned to a game being played;

(c) a second digital circuit for establishing one or more game rules, each game rule defining the application of one of said color state vectors, a single game rule being assigned to a game being played; and (d) a third circuit, interconnected with said first digital circuit and said second digital circuit, for changing the color, if required by the game rule, of at least one of said lightable positions;

whereby in response to a manipulation of said puzzle body to bring one of said lightable positions into a reference plane said first digital circuit, said second digital circuit, and said third circuit cooperate to change the color of at least one of said lightable positions to the next color, if required by the game rule, said next color being determined by the color state vector of the game being played and by the game rule of said game being played.

2. The electronic puzzle of claim 1 wherein each of said plurality of lightable positions comprises a group of differently colored lights.

3. The electronic puzzle of claim 2 wherein each of said groups of differently colored lights comprises three differently colored LEDs.

4. The electronic puzzle of claim 3 wherein the LEDs are red, green, and yellow.

5. The electronic puzzle of claim 1 wherein said puzzle body comprises four panels assembled to form a tetrahedron that defines one of said lightable positions at each of its four vertexes.

6. The electronic puzzle of claim 5 wherein said third circuit comprises a position sensor switch for informing said first digital circuit and said second digital circuit of the current position of said tetrahedron.

7. The electronic puzzle of claim 6 wherein said position sensor switch comprises:

a housing having a cavity defining four positions, wherein each of the four positions corresponds to one of said vertexes;

a ball located within said cavity that is free to roll to any of said four positions; and conducting pins at at least three of said positions for informing the third circuit of the location of said ball.

8. The electronic puzzle of claim 7 wherein said position sensor switch is used to select different games.

9. The electronic puzzle of claim 1 further comprising a speaker for emitting audio noises indicating a change in color at each of said lightable positions.

10. The electronic puzzle of claim 1 wherein one of said game rules comprises advancing one color in the lightable position brought into the reference plane, according to the color state vector.

11. The electronic puzzle of claim 1 wherein one of said game rules comprises advancing one color in the lighable position brought into the reference plane and advancing one color in the lightable position previously occupying the reference plane according to the color state vector.

12. The electronic puzzle of claim 1 wherein one of said game rules comprises advancing one color in the lightable position brought into the reference plane according to the color state vector if that lightable position was not brought into the reference plane in the previous two turns.

13. The electronic puzzle of claim 1 wherein one of said game rules comprises advancing one color in the color state vector for each of the three lightable positions that are not brought into the reference plane.

14. The electronic of puzzle of claim 1 wherein one of said game rules comprises advancing one color in the lightable position brought into the reference plane, advancing one color in the lightable position previously occupying the reference plane and backing up one color in each of the remaining two lightable positions, all in accordance with the color state vector.

* * * * *

UNITED STATES PATENT AND TRADEMARK OFFICE

CERTIFICATE OF CORRECTION

PATENT NO. : 4,957,291

DATED : September 18, 1990

INVENTOR(S) : Donald C. Miffitt et al

It is certified that error appears in the above-identified patent and that said Letters Patent is hereby corrected as shown below:

Column 1, line 66: after "discussed", insert --below,--.

Column 2, line 54: replace "LEDs 6" with --LEDs 16--.

Column 4, line 49: "battery and" should read --battery 37 and--.

Column 4, line 50: after "speaker", insert --36--.

Signed and Sealed this

Twenty-fourth Day of December, 1991

*Attest:*

HARRY F. MANBECK, JR.

*Attesting Officer*

*Commissioner of Patents and Trademarks*